US011191380B2

(12) United States Patent
Leatherman

(10) Patent No.: US 11,191,380 B2
(45) Date of Patent: Dec. 7, 2021

(54) ADJUSTABLE VESSEL HOLDER

(71) Applicant: Lacie Leatherman, Mulvane, KS (US)

(72) Inventor: Lacie Leatherman, Mulvane, KS (US)

( * ) Notice: Subject to any disclaimer, the term of this patent is extended or adjusted under 35 U.S.C. 154(b) by 0 days.

(21) Appl. No.: 16/545,785

(22) Filed: Aug. 20, 2019

(65) Prior Publication Data

US 2021/0052096 A1 Feb. 25, 2021

(51) Int. Cl.
*A47G 23/02* (2006.01)
*B65D 81/38* (2006.01)
*A47G 19/22* (2006.01)

(52) U.S. Cl.
CPC ..... *A47G 23/0216* (2013.01); *A47G 19/2288* (2013.01); *B65D 81/3876* (2013.01)

(58) Field of Classification Search
CPC ..... B65D 81/3876; B65D 81/3886; B65D 81/3888; B65D 25/34; B65D 2313/02; A47G 23/0216; A47G 23/032; A47G 9/062; A47G 19/2288
USPC ..... 220/4.08, 7, 903, 739, 737, 220/592.24–592.25; 206/6, 545; 383/97, 383/10, 110, 2, 40, 66; D24/199; D7/603, 607–608, 624.2; 99/275
See application file for complete search history.

(56) References Cited

U.S. PATENT DOCUMENTS 2,376,194 A * 5/1945 Samuels ..... B65D 65/08 383/66
2,733,710 A * 2/1956 Zibell ..... A61J 9/08 126/263.01
2,838,085 A * 6/1958 Beeler ..... A62B 25/00 190/115
4,180,111 A * 12/1979 Davis ..... A45C 7/0063 383/10
4,194,627 A * 3/1980 Christensen ..... B65D 81/3876 206/545
4,197,890 A * 4/1980 Simko ..... F25D 31/007 383/97
4,478,265 A * 10/1984 DeMarco ..... B65D 81/3879 220/682

(Continued)

FOREIGN PATENT DOCUMENTS

CN 304889941 11/2018

OTHER PUBLICATIONS

Notice of Grant received for Chinese Design Patent Application No. 2017305120860 dated Sep. 5, 2018, 5 pages including 2 pages of English translation.

*Primary Examiner* — J. Gregory Pickett
*Assistant Examiner* — Brijesh V. Patel
(74) *Attorney, Agent, or Firm* — Dorsey & Whitney LLP

(57) ABSTRACT

An adjustable vessel holder, such as an adjustable beverage container holder, is adjustable between a first position and a second position and includes a sleeve and at least one closure coupled to the sleeve. The at least one closure is configured to have a closed position and an open position. In the closed position, the adjustable vessel holder is in the first position and is configured to receive a vessel having a first size. In the open position of the closure, the adjustable vessel holder is in the second position and is configured to receive a different vessel having a second size. In some vessel holders, in the first position, a top end has a first internal perimeter, and in the second position, the top end has a second internal perimeter that is larger than the first internal perimeter.

8 Claims, 6 Drawing Sheets

(56) References Cited

U.S. PATENT DOCUMENTS

D282,234 S 1/1986 Henderson
4,871,597 A 10/1989 Hobson
D321,939 S * 11/1991 Tom ..... D24/199
5,251,460 A * 10/1993 DeMarco ..... B65D 81/3886 220/592.19
5,680,958 A * 10/1997 Mann ..... B65D 25/2873 220/739
5,915,580 A 6/1999 Melk
D414,083 S * 9/1999 Hamilton ..... D7/607
6,073,796 A * 6/2000 Mogil ..... A45F 3/16 215/12.1
D432,873 S 10/2000 Fair
D470,310 S * 2/2003 Walley ..... B65D 81/3876 D7/607
6,655,543 B2 * 12/2003 Beuke ..... B65D 81/3876 220/739
6,866,159 B2 * 3/2005 Yamane ..... A45F 5/00 150/901
D505,837 S * 6/2005 Lima ..... D7/603
D614,001 S * 4/2010 Welch ..... B65D 81/3876 D7/605
7,753,589 B2 * 7/2010 Palt ..... F17C 13/084 383/66
7,845,508 B2 * 12/2010 Rothschild ..... A45C 15/00 220/7
D666,060 S * 8/2012 Welch ..... D7/606
D678,731 S 3/2013 Oneill
D701,433 S 3/2014 Ahlstrom
9,060,581 B2 * 6/2015 Lown ..... A45C 13/02
9,193,516 B2 * 11/2015 Hiner ..... B65D 81/3876
D745,811 S * 12/2015 Reaux ..... D7/607
D766,570 S * 9/2016 Kao ..... D3/229
9,688,457 B1 * 6/2017 Healy ..... B65D 81/3888
D796,270 S * 9/2017 McConnell ..... D7/625
D826,004 S 8/2018 Leatherman
D880,255 S * 4/2020 Randall ..... B65D 81/3876 D7/624.2
2005/0139081 A1 * 6/2005 Lima ..... B65D 81/3886 99/275
2006/0043097 A1 * 3/2006 Tulp ..... A47G 23/0216 220/737
2008/0017654 A1 1/2008 Chu
2008/0164269 A1 7/2008 Vorderkunz
2009/0294463 A1 12/2009 Stack
2012/0285973 A1 * 11/2012 Hargett ..... A47G 23/0216 220/592.24
2013/0334237 A1 * 12/2013 Priest ..... B67B 7/40 220/739
2018/0044082 A1 * 2/2018 Dearing ..... A47G 23/0216
2019/0008300 A1 * 1/2019 Graber ..... A47G 23/0216
2019/0322440 A1 * 10/2019 Tarbutton ..... B65D 81/3876

* cited by examiner

ADJUSTABLE VESSEL HOLDER

TECHNICAL FIELD

Adjustable vessel holders include closures with an open position and a closed position that enables the vessel holders to be adjusted to hold vessels of different sizes.

BACKGROUND

Can holders that encircle the circumference and bottom of a can while leaving the top exposed for a user to drink from the can are known as koozies®. These commonly are formed of a foam polymer that has an internal circumference that allows the can holder to hug the can once inserted, and the holder includes a bottom that prevents the can from falling out of the bottom of the holder. The holder is often insulated.

SUMMARY

According to certain implementations, an adjustable vessel holder is configured to be adjusted between a first position and a second position and includes a sleeve and at least two closures coupled to the sleeve. The at least two closures configured to have a closed position and an open position. In the closed position of the closures, the adjustable vessel holder is in the first position and is configured to receive a vessel having a first external circumference. In the open position of the closures, the adjustable vessel holder is in the second position and is configured to receive a different vessel having a second external circumference larger than the first.

In various implementations and alternatives, at least one of the closures may be a zipper, or a hook and loop closure. Between the closed and open positions of the at least two closures, the closures may have one or more intermediate positions. The sleeve may have a bottom portion configured to support a bottom of a vessel upon insertion into the vessel holder. At least one of the closures may be coupled to a sidewall of the sleeve.

In various implementations and alternatives, in the first position, the vessel holder at a top end has a first internal perimeter, and in the second position, the vessel holder at the top end has a second internal perimeter that is larger than the first internal perimeter. In such implementations, in the first position and second position, the vessel holder may have an internal perimeter at a bottom end of the vessel holder that is substantially the same, and the internal perimeter at the bottom end of the vessel holder is smaller than the second internal perimeter at the top end of the vessel.

In various implementations and alternatives, the sleeve includes a gusset configured to expand in the open position of the closure. The vessel holder may be constructed of an insulated material.

In various implementations and alternatives, in the first position, the vessel holder may be configured to hold a beverage can having an external circumference, and in the second position, the vessel holder is configured to hold a cup with at least a portion having a larger external circumference compared to the external circumference of the beverage can.

According to further implementations, an adjustable vessel holder is configured to be adjusted between a first position and a second position, and includes sleeve and at least one closure coupled to the sleeve and a gusset coupled to the sleeve. The at least one closure is configured to have a closed position and an open position. In the closed position of the closure, the gusset is collapsed and the adjustable vessel holder is in the first position and is configured with a first internal perimeter configured to receive a first vessel having a first external circumference. In the open position of the closure, the gusset is expanded such that the adjustable vessel holder is in the second position and is configured with a second internal perimeter that is larger than the first internal perimeter and is configured to receive a different vessel having a larger external circumference relative to the first vessel.

In various implementations and alternatives, in the first position and second position, the vessel holder has an internal perimeter at a bottom end of the vessel holder that is substantially the same, and the internal perimeter at the bottom end of the vessel holder is smaller than the second internal perimeter at the top end of the vessel.

In various implementations and alternatives, the at least one closure is a zipper or a hook and loop closure.

In various implementations and alternatives, the sleeve includes a bottom portion configured to support a bottom of a vessel upon insertion into the vessel holder.

In various implementations and alternatives, the at least one closure includes two closures. The vessel holder may be constructed of an insulated material. The sleeve may be constructed of at least one of a flexible polymer, a fabric, or combinations.

According to further implementations, an adjustable beverage container holder is configured to be adjusted between a first position and a second position and includes a sleeve and at least one closure coupled to the sleeve and a gusset coupled to the sleeve. The at least one closure is configured to have a closed position and an open position. In the closed position of the closure, the gusset is collapsed and the adjustable beverage container holder is in the first position and is configured with a first internal perimeter configured to receive a first beverage container having a first external circumference. In the open position of the closure, the gusset is expanded such that the adjustable beverage container holder is in the second position and is configured with a second internal perimeter that is larger than the first internal perimeter and is configured to receive a different beverage container having a larger external circumference relative to the first beverage container.

DETAILED DESCRIPTION

Disclosed are adjustable vessel holders configured to be adjusted between a first position and a second position to enable the vessel holders to be adjusted to hold vessels of different sizes. For instance, in a first position, the vessel holder may be configured to hold a can (e.g. holding a beverage), and in the second position, the vessel holder may be configured to hold a cup for holding liquid. The adjustable vessel holders are adjustable due to at least one closure being coupled to a sleeve that can be moved between a closed and an open position. This enables the adjustable vessel holders to have an adjustable internal volume.

Figure 1:
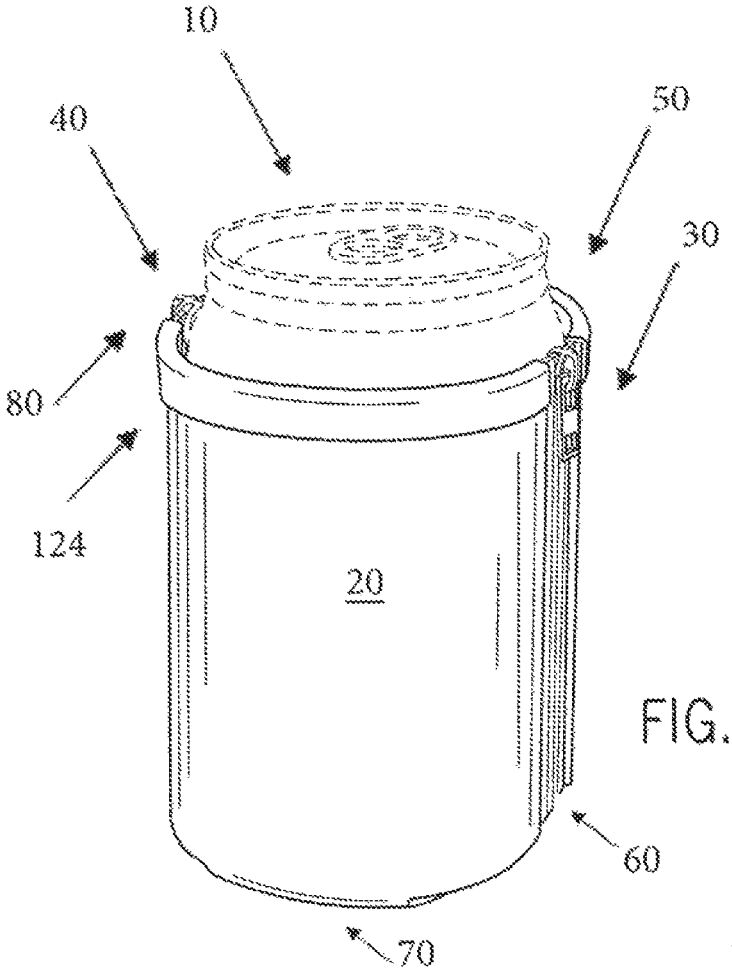
FIG. 1 is an illustration of an isometric view of an adjustable vessel holder in a first position according to certain implementations.
Figure 2:
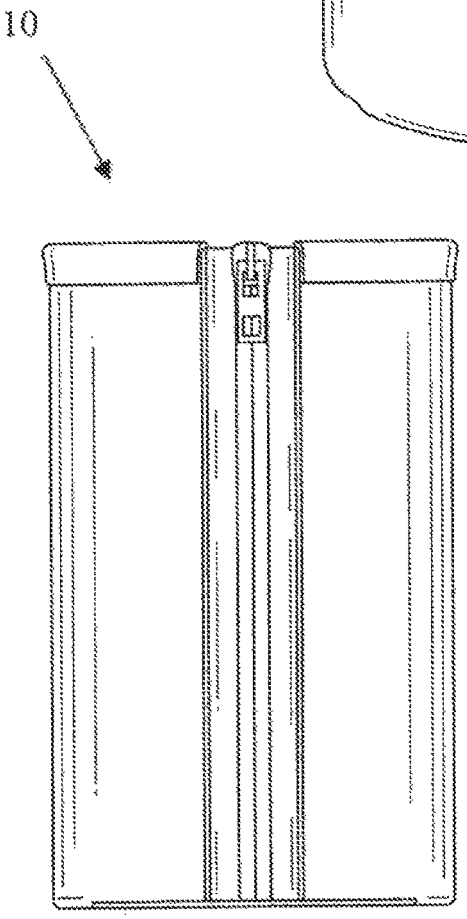
FIG. 2 is an illustration of a front view of the adjustable vessel holder in the first position according to certain implementations.
Figure 3:
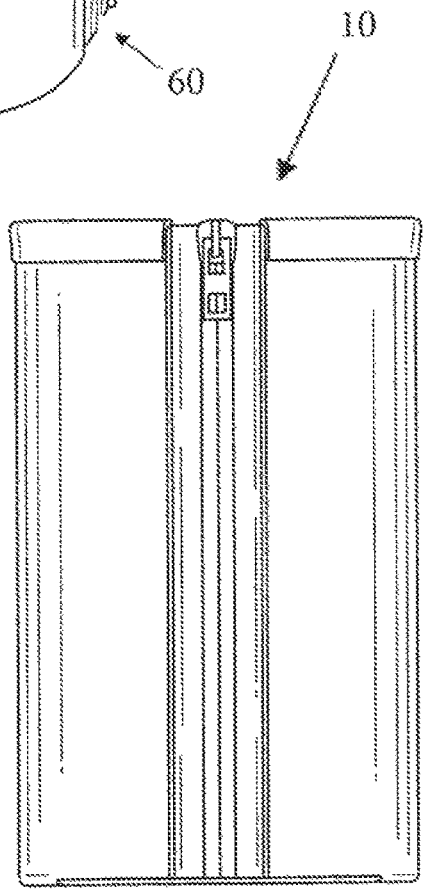
FIG. 3 is an illustration of a back view of the adjustable vessel holder in the first position according to certain implementations.
Figure 4:
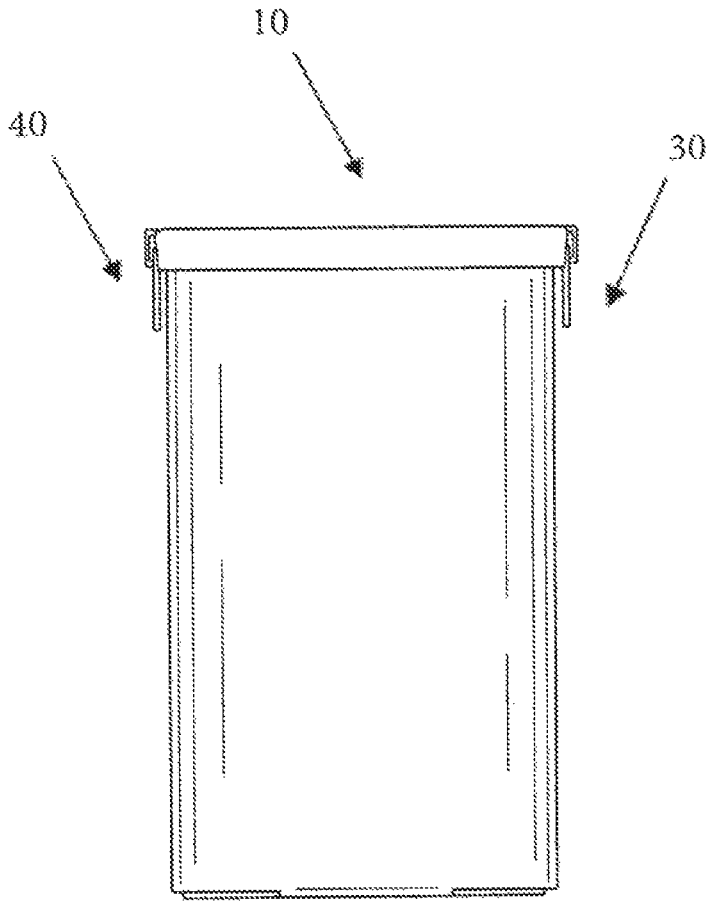
FIG. 4 is an illustration of a right side view of the adjustable vessel holder in the first position according to certain implementations.
Figure 5:
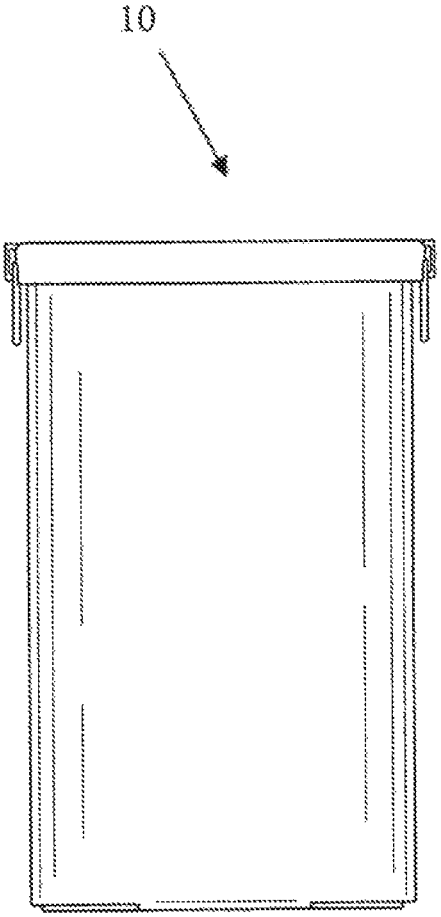
FIG. 5 is an illustration of a left side view of the adjustable vessel holder in the first position according to certain implementations.

Referring to FIG. 1, the vessel holder 10 may include a generally cylindrical shape with at least one opened end and includes a sleeve 20 and at least one closure 30 coupled to the sleeve 20. In FIG. 1, a second closure 40 is also coupled to the sleeve 20. A top end 50 of the vessel holder defines an opening for receiving vessels therein. The closures 30, 40 extend from the top end 50 of the vessel holder 10 to a bottom end 60 of the vessel holder 10. At the bottom end 60, the vessel holder 10 may include a bottom portion 70.

Figure 8:
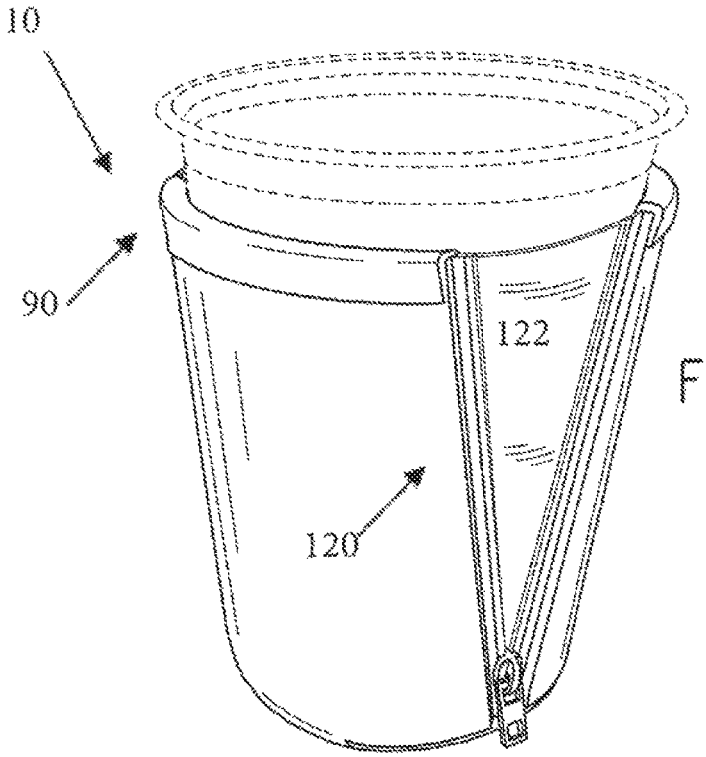
FIG. 8 is an illustration of an isometric view of the vessel holder in a second position according to certain implementations.
Figure 9:
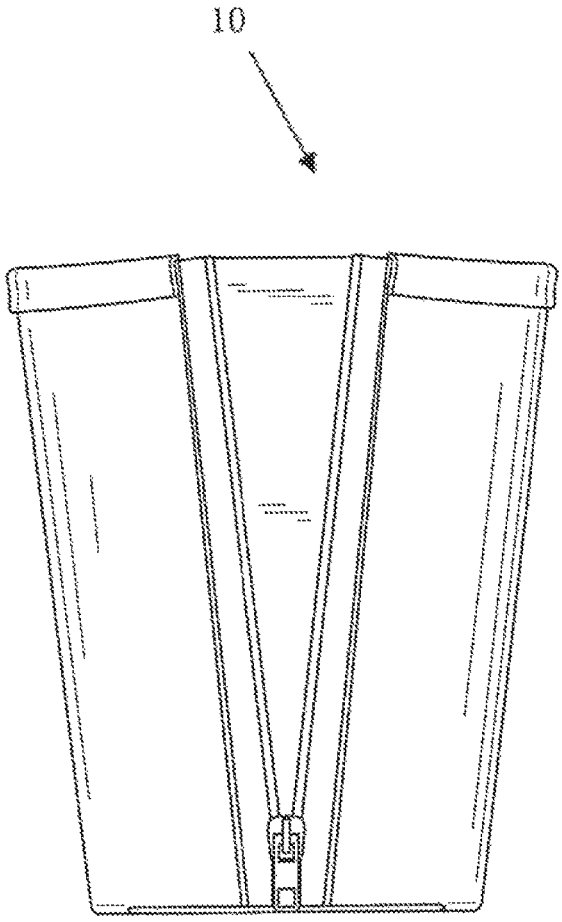
FIG. 9 is an illustration of a front view of the vessel holder in the second position according to certain implementations.
Figure 10:
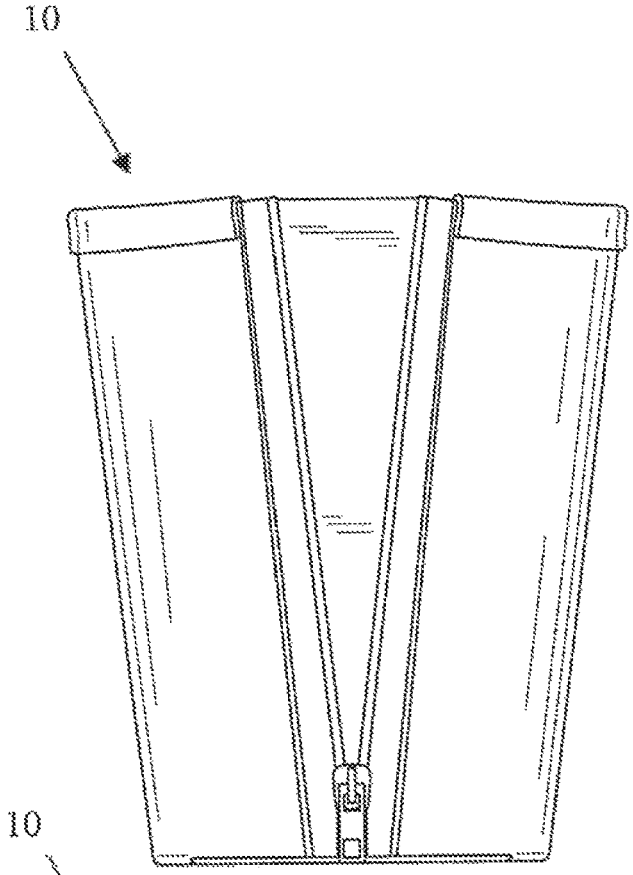
FIG. 10 is an illustration of a back view of the vessel holder in the second position according to certain implementations.
Figure 11:
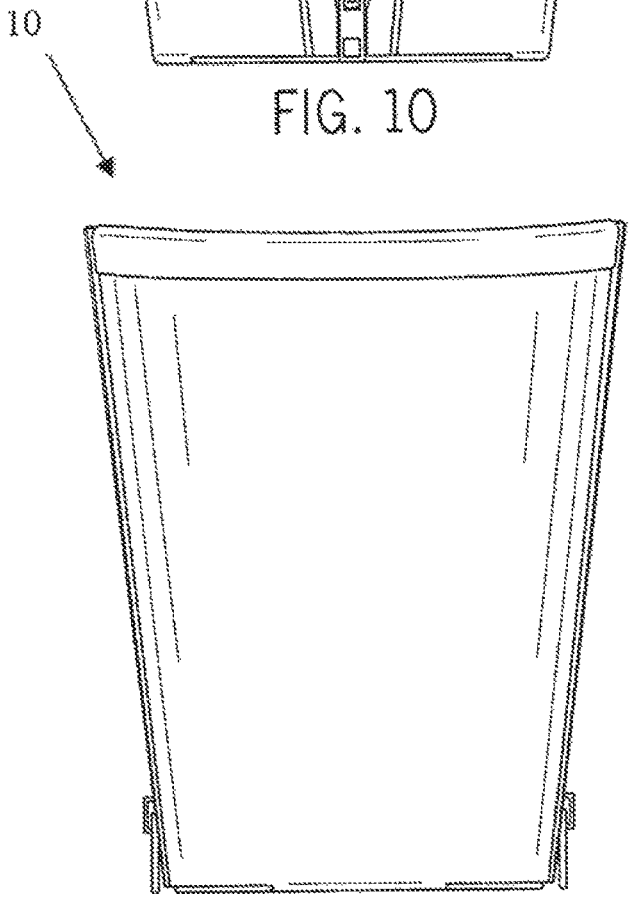
FIG. 11 is an illustration of a right side view of the vessel holder in the second position according to certain implementations.
Figure 12:
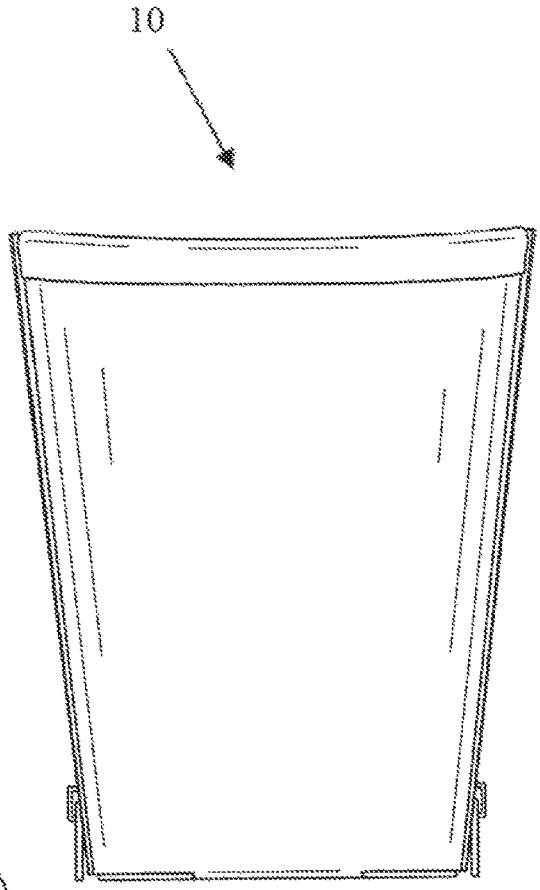
FIG. 12 is an illustration of a left side view of the vessel holder in the second position according to certain implementations.
Figure 13:
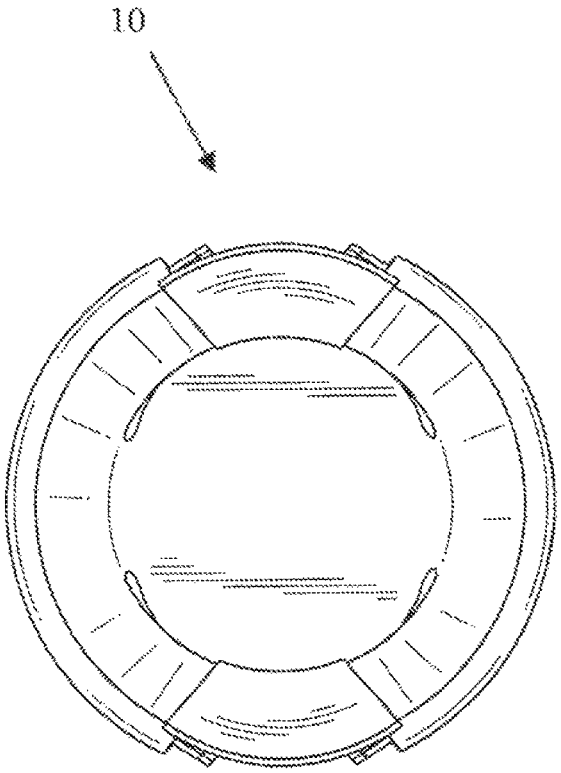
FIG. 13 is an illustration of a top view of the vessel holder in the second position according to certain implementations.
Figure 14:
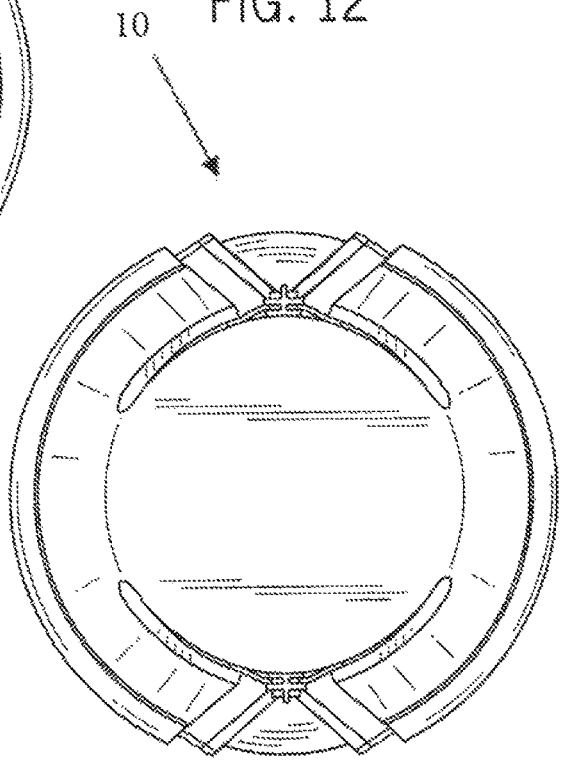
FIG. 14 is an illustration of a bottom view of the vessel holder in the second position according to certain implementations.

FIG. 1 depicts the adjustable vessel holder 10 in a first position where the closures 30, 40 are in a closed position. In this configuration, the vessel holder 10 has a first internal volume and at the top end 50 (e.g., the end where the vessel is inserted) has a first internal perimeter 80 (e.g., a first internal circumference), and in the second position when the closures 30, 40 are in an open position (see FIG. 8), the adjustable vessel holder 10 has a second internal volume larger than the first internal volume, and at the top end 50 has a second internal perimeter 90 (e.g., a second internal circumference) that is larger than the first internal perimeter 80. The adjustable volume and adjustable internal perimeter of the vessel holder 10 enables a variety of vessels having differing external circumferences (or perimeters for instance if the vessel is not cylindrical) to be inserted into the vessel holder 10. For instance, in the closed position of the closures 30, 40, the adjustable vessel holder 10 is in the first position and is configured to receive a vessel having a first size, and in the open position of the closure 30, 40, the adjustable vessel holder 10 is in the second position and is configured to receive a different vessel having a second size that has a larger external circumference, e.g., in an area where this vessel is received by the top end 50 of the adjustable vessel holder 10.

The sleeve 20 of the adjustable vessel holder 10 may be formed of a flexible or pliable material such as a polymer (e.g., polyethylene, polypropylene, neoprene), a fabric (e.g., cotton, nylon, wool) or combinations (e.g. a fabric covered polymer foam). The material may be woven, knit and so on. The sleeve 20 may be formed of multiple segments, or may be unitarily formed one piece of material. The sleeve 20 may be configured with elasticity to enable the adjustable vessel holder 10 to conform to an external surface of a vessel inserted therein. For instance, the sleeve 20 may include a flexible polymer such as a foamed polypropylene that may expand upon insertion of a vessel. The sleeve 20 may additionally or alternatively be configured with pliable material that does not necessarily have elasticity or much elasticity (e.g., woven cotton or nylon). Particularly, because the adjustable vessel holder 10 includes at least one closure (e.g., closure 30), the sleeve 20 may be constructed of a material that can pliably surround a vessel inserted in to the vessel holder 10 but the material does not require elasticity since the closure can be opened prior to insertion of the vessel, and be closed, at least partially or fully, upon insertion of the vessel. In some implementations, the sleeve 20 may be insulated to assist with keeping a cooled beverage cool while arranged in the adjustable vessel holder 10.

The closure of the adjustable vessel holder 10, e.g., one or more of closures 30, 40, may extend along a sidewall 120 of the sleeve 20 and be coupled to the sleeve 20. The coupling may be via fastening, adhering, joining, gluing, sewing, and so on. In a closed position of the vessel holder 10, the sleeve and the closure may define an internal volume that may be shaped cylindrically (see, e.g., FIG. 1), and in the open position, the sleeve and the closure may define another internal volume that may be cone shaped (see, e.g., FIG. 8). The closures may extend vertically along the sleeve. In the closed position, the closure may be arranged substantially vertically along the sleeve, and in the open position, the sides of the closure may separate from one another in order to form an opening at a top end of the sleeve and accordingly may be arranged at a slight angle. The closure may extend along all or a portion of the sidewall 120 of the sleeve 20. FIG. 1 illustrates the closures 30, 40 extending vertically along the sidewall 120 of the sleeve 20 from a top end 50 to a bottom end 60 of the adjustable vessel holder 10. However, the closures 30, 40 may extend along the sidewall 120 along just a portion of the sleeve 20 and may provide an opened and a closed position along just a portion of the sleeve 20. The closure may extend from a top portion 50 down, or may extend from a bottom portion 60 up along the sidewall 120 of the sleeve 20.

The one or more closures, e.g., closures 30, 40, may be configured as one or more of a zipper, a hook and loop closure, a snap closure, a hook closure, a folding closure, a magnetic closure, a fan-shaped closure, and combinations thereof. One, two, three, four or more closures may be provided on the adjustable vessel holder 10. The closure may cause two edges of the sleeve 20, e.g., edges of the sidewall 120, to be drawn together when the closure moves from the open position (FIG. 8) to the closed position (FIG. 1). In some implementations, the closure may be releasably attachable to the sleeve 20. For instance, the closure may include one side of a snap mechanism, e.g., the female side, and the sleeve 20 may include the male side of a snap mechanism. The sleeve 20 may be adjusted by releasing and affixing the female side of the snap mechanism to the male side. In a more particular example, a piece of material may be affixed to a pair of snap mechanisms that can be joined to the sleeve 20 on either side of the sidewalls 120 to be drawn together by opposing snap mechanisms joined to the sleeve 20. In addition or alternatively, the closures may attach to an internal or an external surface of the sleeve 20. In addition or alternatively, the closures may be permanently affixed to the vessel holder, e.g., a zipper may be affixed to the adjustable vessel holder 10 by sewing.

Figure 6:
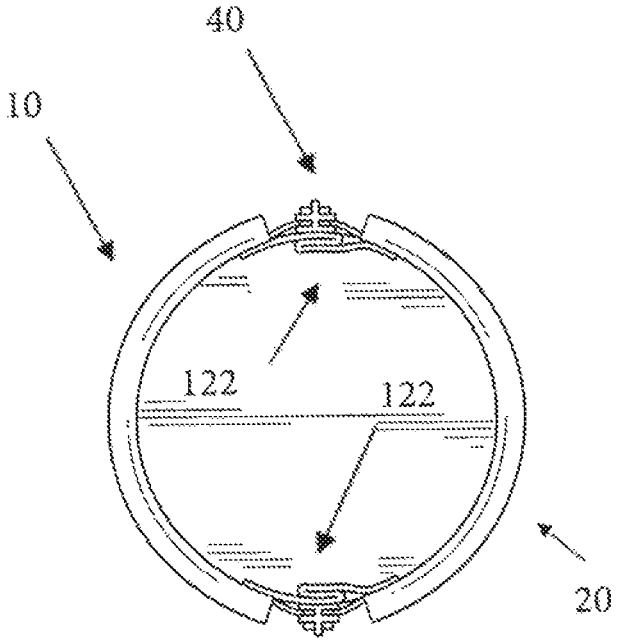
FIG. 6 is an illustration of a top view of the adjustable vessel holder in the first position according to certain implementations.
Figure 7:
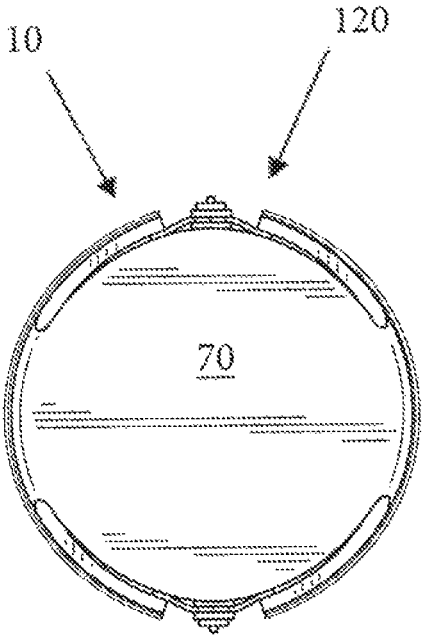
FIG. 7 is an illustration of a bottom view of the adjustable vessel holder in the first position according to certain implementations.

In some implementations, the closure causes a gusset 122 (see FIG. 6) of the sleeve 20 to collapse as the closure moves from the open position to the closed position. The gusset 122 provides a way of adjusting the internal perimeter of the adjustable vessel holder 10 and, for instance, may define a wedge or V-shape that tapers towards the bottom of the adjustable vessel holder. The gusset 122 may be optional, and when present, may generally be a piece of material sewn or fastened to the adjustable vessel holder 10 to expand a part of its sidewall. In addition or alternatively, the gusset 122 may have a triangular shape, rhomboidal shape, parallelogram shape, square shape or any other shape. Gusset material may be the same or different from the sleeve material. The gusset 122 may extend along all or a portion of the sleeve 20. The gusset 122 may be arranged within and interior of the adjustable vessel holder 10 in the closed position of the closure. For instance, as shown in FIG. 6, the gusset 122 is disposed in an interior the adjustable vessel holder 10. In some implementations, the gusset 122 may facilitate in reducing the internal perimeter of the adjustable vessel holder 10 and may enable vessels of a smaller circumference (compared to the internal perimeter of the sleeve 20) to be securely arranged against both the gusset 122 and the internal perimeter of the sleeve 20. For instance, in the closed position of the adjustable vessel holder 10, a beverage can having an external circumference of about 6.6 in. may be inserted and securely arranged against both the gusset 122 and the internal perimeter of the sleeve 20; and a different beverage can having an external circumference of about 8.2 in. may be inserted into the adjustable vessel holder 10 in an open position of the closure(s) and the closure(s) may then be closed (or partially closed to an intermediate position) in order to securely arrange the larger can within the adjustable vessel holder 10; and a cup having an external circumference larger than about 8.2 in. may be inserted into the adjustable vessel holder 10 in the open position of the closure(s) and the closure(s) may not be closed (or may be partially closed to a lesser extent than when the can having the 8.2 in. external circumference is inserted).

In some implementations, a bottom portion 70 of the adjustable vessel holder 10 is optionally provided. The bottom portion 70 may be integrally formed with the sleeve 20 or may be separately constructed and joined to the sleeve 20.

In some implementations, a lip 124 may be provided on a top portion 50 of the adjustable vessel holder 10. The lip 124 may be integrally formed by the sleeve 20 or may be separately constructed and joined to the sleeve 20. The lip 124 may define the opening of the adjustable vessel holder 10 where the vessel is inserted. The lip 124 may facilitate securing the vessel in an interior of the adjustable vessel holder 10, for instance, by providing a slightly smaller internal perimeter at the opening of the vessel holder 10 as compared to a region below the opening where the lip 124 terminates and the sleeve 20 is provided as the internal perimeter of the adjustable vessel holder 10.

The adjustable vessel holder 10 may be constructed by adjoining the sleeve 20 to the one or more closures, e.g., closures 30, 40, to define an internal volume (e.g., with a generally cylindrical shape) with at least one opened end, e.g., at the top end 50 of the adjustable vessel holder 10. The construction enables the closure of the adjustable vessel holder 10 to remain in a closed position or an opened position as desired, and can be moved between the opened and closed positions by a user separating or fastening the closure with one or two hands.

In one example of use, the adjustable vessel holder 10 is provided in a closed position and a beverage can is inserted therein. The can may have a diameter of about 1.6 to 2.8 inches, and at least the top end 50 of the adjustable vessel holder 10 may have an internal perimeter that can receive the external circumference of such a can. For instance, where the diameter of the can is 2.6 inches and the circumference is 8.2 in., the first internal perimeter 80 of the adjustable vessel holder 10 may have a circumference of about 8.2 in. or slightly smaller or slightly larger (e.g. +/−0.1, 0.2, 0.3, 0.4, 0.5, 0.6, 0.7, 0.8, 0.9 or 1.0 in.) depending on the material used to construct the sleeve 20 and closure 30 and/or 40. A bottom end 60 of the adjustable vessel holder 10 may have a similar internal perimeter as the top end 50 or may be slightly smaller or slightly larger (e.g. +/−0.1, 0.2, 0.3, 0.4, 0.5, 0.6, 0.7, 0.8, 0.9 or 1.0 in.). Continuing with this example of use, in the open position of the adjustable vessel holder 10, while the beverage can may still be received therein, other vessels may be used to replace the can. In the open position, the second internal circumference 90 may be relatively larger and may have a perimeter adapted to receive a cup with a tapering sidewall. The cup may have a diameter of about 3.0 to 4.2 inches, and the adjustable vessel holder 10 may have a second internal circumference that can receive the cup. For instance, where the diameter of the cup at its top end is about 3.5 inches and an outer circumference of about 11 in., the top end 50 of the adjustable vessel holder 10 may have a second internal perimeter 90 with a circumference of about 11 in. or slightly smaller or slightly larger (e.g. +/−0.1, 0.2, 0.3, 0.4, 0.5, 0.6, 0.7, 0.8, 0.9 or 1.0 in.) depending on the material used to construct the sleeve 20 and closure 30 and/or 40. It will be understood that the internal perimeter of the adjustable vessel holder 10 may include any internal perimeter and that the vessel holder 10 generally includes a smaller internal perimeter in the closed position of the closure(s). The height of the adjustable vessel holder may be about 4.0 to about 10.0 in., about 4.0 to about 8.0 in., about 4.0 to about 6.0 in., about 3.0 to about 6.0 in., or about 5.5 in. When the vessel is inserted, the internal perimeter of the vessel holder 10 may conform to the vessel and may define an internal circumference that conforms to all or a portion of the external circumference of the vessel inserted therein. In addition, the internal perimeter 80 at the top end 50 of the adjustable vessel holder 10 may be different from an internal perimeter at the bottom end 60 of the adjustable vessel holder 10. For instance, the adjustable vessel holder 10 may be configured to have a top internal perimeter with a circumference of about 11.4 in., a bottom internal perimeter with a circumference of about 9.25 in., and a height of about 5.5 in.

In some implementations, the adjustable vessel holder 10 can move between the closed and open positions by way of one or more intermediate positions in order to receive vessels of a variety of sizes, e.g., 5-10, 10-20, 10-50, 10-100 or more different sizes. A zipper closure and/or a hook and loop closure, for instance, may be moved to many different partially open or partially closed positions between the top end 50 and the bottom end 60 of the adjustable vessel holder 10. Accordingly, the closure(s) may be incrementally adjusted between the open and the closed positions.

Figure 15:
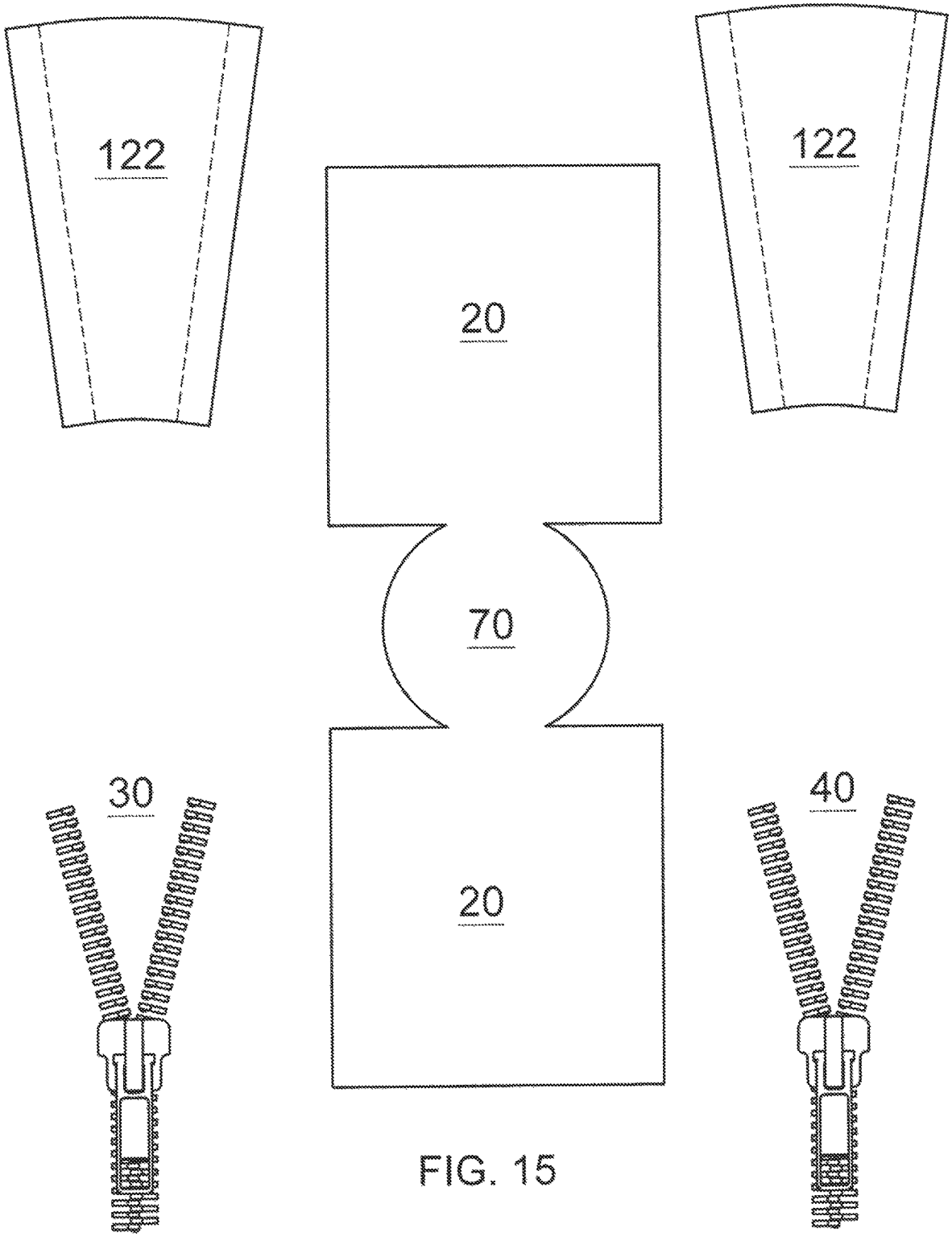
FIG. 15 is an illustration of individual components of the adjustable vessel holder according to certain implementations.

FIG. 15 is an illustration of individual components of the adjustable vessel holder 10 according to certain implementations. In FIG. 15, the components include the sleeve 20, two gussets 122 and one closures 30, but it will be understood that an additional closure 40 may be included. The sleeve 20 at each of its four sidewalls 120 may be joined to both a gusset 122 and a closure 30 or 40 in order to construct a cylindrically shaped vessel holder 10 (e.g., as illustrated in FIG. 1). The gusset 122 may be arranged behind the closure 30, 40, and for instance, the gusset 122 may be joined to an interior of the sleeve 20 at the sidewall 120 via the closure 30 or 40, which may also be joined to an interior of the sleeve 20. In another example, the closure 30 or 40 may be joined directly to the sleeve 20 and the gusset 122 also be joined the directly to the sleeve 20. In an alternative, one or both of the gusset 122 and closures 30, 40 may be joined to an exterior of the sleeve 20.

Various components of the adjustable vessel holder 10 may be integrally constructed or constructed using methods of fastening or fasteners. The integral construction may be, for instance, by molding (e.g., injection molding) a chemically inert polymer such as HDPE, PTFE or PVDF, plastic, material, and so on. These and other materials may be fastened to form the adjustable vessel holder 10.

Although certain embodiments of the present disclosure are described herein with reference to the examples in the accompanying figures, it would be apparent to those skilled in the art that several modifications to the described embodiments, as well as other embodiments of the present invention are possible without departing from the spirit and scope of the present disclosure.

What is claimed is:

1. An adjustable beverage vessel holder configured to be adjusted between a first position and a second position, the adjustable beverage vessel holder comprising:

a sleeve, a first closure, a second closure, a first gusset, and a second gusset, each of the first closure and the second closure being coupled to the sleeve and being configured to have a closed position and an open position, each of the first gusset and the second gusset having a V-shape that taper toward a bottom end of the adjustable beverage vessel holder and configured to expand as the first closure and the second closure move to the open position and to collapse as the first closure and the second closure move to the closed position, wherein the adjustable beverage vessel holder is in the first position when each of the first closure and the second closure is in the closed position and the first gusset and the second gusset are collapsed, the adjustable beverage vessel holder defining a first internal perimeter having a circumference of about 7.2 in. to about 9.2 in. and configured to snugly receive a single, first type of beverage vessel having a first external circumference corresponding to the first internal perimeter when in the first position, and wherein the adjustable beverage vessel holder is in the second position when each of the first closure and the second closure is in the open position and the first gusset and the second gusset are expanded, the adjustable beverage vessel holder defining a cone shape with a second internal perimeter at a top end having a circumference of about 10 in. to about 12 in. and configured to snugly receive a single, second type of beverage vessel different from the first type and having a second external circumference at a top end corresponding to the second internal perimeter when in the second position, the second external circumference being larger than the first external circumference.

2. The adjustable beverage vessel holder of claim 1, wherein at least one of the first closure and the second closure comprises a zipper.

3. The adjustable beverage vessel holder of claim 1, wherein each of the first closure and the second closure have at least one intermediate position, the at least one intermediate position being between the open position and the closed position.

4. The adjustable beverage vessel holder of claim 1, wherein the sleeve further comprises a bottom portion configured to support a bottom of a vessel upon insertion into the adjustable beverage vessel holder.

5. The adjustable beverage vessel holder of claim 1, wherein at least one of the first closure and the second closure is coupled to a sidewall of the sleeve.

6. The adjustable beverage vessel holder of claim 1, wherein a bottom end of the adjustable beverage vessel holder comprises an internal perimeter that is the same in both the first position and the second position.

7. The adjustable beverage vessel holder of claim 1, wherein the adjustable beverage vessel holder is comprised of an insulated material.

8. The adjustable beverage vessel holder of claim 1, wherein the first type of beverage vessel is a beverage can, and the second type of beverage vessel is a beverage cup.

* * * * *